US011389923B2

(12) United States Patent
Gulkov et al.

(10) Patent No.: US 11,389,923 B2
(45) Date of Patent: Jul. 19, 2022

(54) CHEMICAL-MECHANICAL POLISHING SYSTEM WITH A POTENTIOSTAT AND PULSED-FORCE APPLIED TO A WORKPIECE

(71) Applicant: Bruker Nano, Inc., San Jose, CA (US)

(72) Inventors: Vladimir Gulkov, San Jose, CA (US); Nikolay Yeremin, San Jose, CA (US)

(73) Assignee: BRUKER NANO, INC., San Jose, CA (US)

( * ) Notice: Subject to any disclaimer, the term of this patent is extended or adjusted under 35 U.S.C. 154(b) by 0 days.

(21) Appl. No.: 17/197,386

(22) Filed: Mar. 10, 2021

(65) Prior Publication Data

US 2021/0291313 A1 Sep. 23, 2021

Related U.S. Application Data

(60) Provisional application No. 62/988,602, filed on Mar. 12, 2020.

(51) Int. Cl.

| | |
|---|---|
| ***B24B 37/013*** | (2012.01) |
| ***B24B 37/04*** | (2012.01) |
| ***B24B 37/10*** | (2012.01) |
| ***B24B 37/30*** | (2012.01) |
| ***B24B 49/00*** | (2012.01) |
| ***B24B 49/10*** | (2006.01) |

(52) U.S. Cl.

CPC ..... *B24B 37/013* (2013.01); *B24B 37/042* (2013.01); *B24B 37/046* (2013.01); *B24B 37/107* (2013.01); *B24B 37/30* (2013.01); *B24B 49/006* (2013.01); *B24B 49/10* (2013.01)

(58) Field of Classification Search

CPC ..... B24B 37/005; B24B 37/04; B24B 37/02; B24B 37/044; B24B 37/046; B24B 37/10; B24B 37/102; B24B 37/105; B24B 37/107; B24B 49/003

See application file for complete search history.

(56) References Cited

U.S. PATENT DOCUMENTS 5,593,537 A 1/1997 Cote et al.
5,637,185 A 6/1997 Murarka et al.
(Continued)

FOREIGN PATENT DOCUMENTS

WO 2004111314 A2 12/2004

OTHER PUBLICATIONS

PCT International Search Report, PCT/US2021/021907, dated Jul. 6, 2021, 4 pages.

*Primary Examiner* — Joel D Crandall
(74) *Attorney, Agent, or Firm* — Quarles & Brady LLLP; Yakov S. Sidorin

(57) ABSTRACT

Shortcomings associated with insufficient control of a conventional CMP-process are obviated by providing an CMP-apparatus configured to complement a constant force (to which a workpiece that is being polished is conventionally exposed) with a time-alternating force and/or means for measuring an electrical characteristic of the CMP-process. The time-alternating force is applied with the use of a system component that is electrically isolated from the workpiece and that is disposed in the carrier-chick in which the workpiece is affixed for CMP-process, while the electrical characteristic is measured with the use of a judiciously-configured reservoir in which the used fluid is collected. The use of such CMP-apparatus.

24 Claims, 10 Drawing Sheets

(56) References Cited

U.S. PATENT DOCUMENTS

| | | | | |
|---|---|---|---|---|
| 2002/0052052 | A1 | 5/2002 | Robinson et al. | |
| 2002/0086538 | A1* | 7/2002 | Kojima | H01L 21/30625 438/691 |
| 2002/0111121 | A1 | 8/2002 | Sun et al. | |
| 2003/0213703 | A1* | 11/2003 | Wang | B24B 37/042 205/662 |
| 2004/0173461 | A1* | 9/2004 | Tsai | B24B 37/046 204/640 |
| 2006/0105679 | A1* | 5/2006 | Hirokawa | B24B 37/205 451/6 |

* cited by examiner

| ITEM NO. | Number | VendorNo | DESCRIPTION | QTY. |
|---|---|---|---|---|
| 1 | M308020-2 | | SPRING,FLAT,TYPE 1095,HRC48-51, .015THK | 3 |
| 2 | BM310174 | 92196A143 | SCR,6-32x.187inL,SHC | 14 |
| 3 | M308862 | | CLAMP,AE | 1 |
| 4 | BM310098 | 92210A079 | SCREW, FHC, #2-56 X .375"LG, 18-8 SST | 2 |
| 5 | M308818 | | SPCR, WAFER CARRIER, ADPTR | 1 |
| 6 | AM308745 | | ASM, HLDR W/ BALL JOINT BEARING | 1 |
| 7 | M3081634 | | SLEEVE, PROTECTIVE, WAFER CARRIER | 1 |
| 8 | | CH-S42-50x2.6 | ULTRASONIC TRANSDUCER, OD 50MM, THK 2.6MM | 1 |
| 9 | RED WIRE | | | 1 |
| 10 | M30C2565 | | Insulator, Wafer Vibro Head, ECMP | 1 |
| 11 | M30C2566 | | Disk, Wafer Vibro Head, ECMP | 1 |
| 12 | M30C2564 | | Clamp, Wafer Vibro Head, ECMP | 1 |
| 13 | BM310001 | 92949A105 | SCR,4-40x.188,BHC,SST | 3 |
| 14 | | 0990-1-50-20-75-14-11-0 | SPRING LOADED CONTACT, GOLD | 3 |
| 15 | BM310050 | 92196A105 | SCR,4-40X.187INL,SHC | 3 |
| 16 | BM280056 | 97395A421 | DOWEL PIN, DIA 3/32" X 1/4", 316 SST | 2 |
| 17 | | 70481650 | ADHESIVE MAGNET, THCK .06", OD 3/8", NICKEL PLATED | 6 |
| 18 | M30C2567 | | Wafer Holder, Wafer Vibro Head, ECMP | 1 |
| 19 | M30C2557 | | Sample, Wafer Dimension, ECMP | 1 |
| 20 | | 16086-1, TED PELLA,INC | SILVER CONDUCTIVE SHEET, ADHESIVE, 50x120x0.125 MM | 1 |
| 21 | | 1170N980 | VITON SQUARE O-RING, WD 1/8", ID 2" | 2 |
| 22 | | 97395A351 | DOWEL PIN OD 1/32"x1/8" LG, SST 316 | 2 |
| 23 | BLACK WIRE | | | 3 |
| 24 | M30C2563 | | Base, Wafer Vibro Head, ECMP | 1 |
| 25 | M30C2568 | | Cover, Wafer Vibro Head, ECMP | 1 |
| 26 | PCB | | PCM, VIBRATION HEAD, ECMP | 1 |
| 27 | BM310684 | 95966A130 | SCREW, SHC, CAPTIVE, #4-40 X 3/8"LG, SST | 3 |
| 28 | | 92158A121 | SET SCREW #4-40x 3/16"LG, FLAT-TIP, SST 316 | 3 |
| 29 | | C-1-2834237-1-A-3D | WIRE-TO-BORD VERTICAL CONN, 3P REC | 1 |
| 31 | BM560033 | | SHIM, SHAFT,125ID,187OD,010inTHK SST18-8 | 3 |
| 32 | AM3081131 | | ASM,A/E SENSOR CP-4 | 1 |
| 33 | BM380038 | 93835A360 | PTFE SHOULER WASHER, ID .260", OD .545", HT .094" | 1 |

FIG. 9

CHEMICAL-MECHANICAL POLISHING SYSTEM WITH A POTENTIOSTAT AND PULSED-FORCE APPLIED TO A WORKPIECE

CROSS-REFERENCE TO RELATED APPLICATIONS

This application claims the benefit of U.S. Provisional Patent Application No. 62/988,602, filed on Mar. 12, 2020 and titled "Use of a potentiostat and pulsed force applied to a workpiece to improve chemical-mechanical polishing (CMP) process. The disclosure of this provisional patent application is incorporated herein by reference.

TECHNICAL FIELD

The present invention generally relates to systems for planarization of material surfaces and, in particular, to systems for smoothing surfaces with the combination of chemical and mechanical forces.

RELATED ART

The process of chemical-mechanical polishing (CMP) uses an abrasive and corrosive chemical slurry (which is commonly a colloid) in combination with a polishing pad, typically of a diameter greater than that of the wafer or workpiece being polished. The pad and workpiece are pressed together by a dynamic polishing head and held in place by a plastic retaining ring. The dynamic polishing head may be rotated with different axes of rotation to remove material from the surface of a workpiece and to even out any irregular topography of that surface, making the workpiece flat or planar (which may be necessary to set up the workpiece for the formation of additional circuit elements).

A typical CMP tool, such as the tool 100 schematically shown in FIG. 1 (mimicked from https://en.wikipedia.org/wiki/Chemical-mechanical_polishing) includes a rotating and extremely flat plate (rotating table 104), which is covered by a polishing pad 108. The wafer or workpiece 110 that is being polished is mounted upside-down in a carrier/chuck 114 on a backing film 118. The retaining structure keeps the wafer in the correct horizontal position. A slurry introduction mechanism deposits the slurry on the pad 108. Both the plate 104 and the chuck 114 are then rotated and the chuck is usually kept oscillating. A downward pressure/down force is applied to the chuck 114, pushing it against the pad 108. The downward force typically depends on the contact area which, in turn, is dependent on the structures of both the workpiece and the pad. Generally, the pad 108 is made from porous polymeric materials, and because it is consumed in the process, it must be regularly reconditioned with the conditioning unit 122.

With continued development of CMP strategies, the CMP processes have become more reliant on the slurry chemistry to achieve planarization, while the mechanical function of the CMP has assumed a relatively reduced role. Also, the more chemically complex materials, as well as the new interconnect architectures have presented more challenges in the chemical design of CMP. The strict requirements of controlling surface defects while keeping adequate material selectivity are particularly important. Electrochemistry plays a vital role in these processing-related issues, because the chemical steps of CMP are largely governed by electrochemical reactions. As a result, electrochemical techniques are now recognized as essential tools for designing and evaluating the chemical protocols necessary to tackle the new challenges of CMP, and the need exists in developing technologies facilitating real-time assessment (and even update of chemistry of the slurry.

SUMMARY OF THE INVENTION

Shortcomings associated with insufficient control of the conventional CMP-process are obviated by optionally providing the CMP-apparatus with means for measuring electrochemistry of a slurry-containing liquid used in the CMP-process (to adjust the ionic conductivity of such liquid and, thereby, change efficiency of chemical component of polishing of the workpiece) and/or means configured to complement a constant force (with which a workpiece that is being polished is conventionally pressed against a polishing pad affixed to a component of the apparatus) with a time-alternating (for example, pulsed) force.

The former element of solution involves driving a current through the workpiece (that is in contact with the abrasive-particle-slurry-containing electrolytic liquid, delivered towards the polishing pad through an outlet of a dedicated port) with the use of a working electrode (electrically connected to the back side of the workpiece) and the so-called counter electrode (in contact with the slurry-containing electrolytic liquid collected during the CMP-process in a judiciously-structured reservoir) while using a third electrode (that may be referred to as a reference electrode) that is in contact with the same liquid to determine with the electrical potential of which magnitude to mutually bias the working and the reference electrodes (in one case—with the use of programmed controlling electronic circuitry that includes, for example, a potentiometer and a microcontroller). Such bias—when introduced with the use of the electronic circuitry of the apparatus—causes a change in ionic conductivity of the slurry-containing electrolytic liquid and with it—a desired change of efficiency of the chemical component of the polishing process. Considering various mutual rotational movements/motions present among the components of the apparatus during the polishing process, the electrical connections between these electrodes and the electronic circuitry are advantageously drawn through at least one slip-ring, thereby addressing yet other shortcomings present in the CMP machines of related art.

The latter element of solution—that is, the use of the time-alternating force—is achieved with the use of a piezoelectric component of the apparatus that is electrically insulated from the workpiece, that is electrically-connected with the electronic circuitry of the apparatus through a slip-ring, and that is disposed in the carrier-chick in which the workpiece is affixed (and optionally—while and simultaneously with the electrical characteristic being measured as mentioned above). Optionally but preferably, the frequency of application of the time-alternative force with which the workpiece (affixed in the workpiece holder to be polished) is pressed against the polishing pad during the CMP-process is adjusted by controlling a voltage (applied to the piezoelectric element with the use of the microcontroller) such as to shift a frequency of operation of the piezoelectric element towards an eigenfrequency of mechanical vibration(s) of the apparatus (in order to increase the amplitude of the vibrations transferred from the piezoelectric element to the workpiece). The eigenfrequency of the mechanical vibration(s) of the apparatus could be measured with the use of an acoustic sensor (disposed in the chuck head of the apparatus and preferably connected with the electronic circuitry through the slip-ring) during the periods of time when the piezoelectric element is not under voltage, or pre-determined otherwise. The same acoustic sensor is used to monitor the process of polishing by providing measurement data representing the mechanical vibrations caused by the friction between a surface of the workpiece being polished and the polishing pad during periods of time when the piezoelectric element is not active.

Generally, according to the idea of the invention, at least one—and, preferably, both—of the above-identified solutions/means—is implemented in a given embodiment of the apparatus. Embodiments of the invention address and solve complexity of the structure of the workpiece holder (also interchangeably referred to herein as the wafer head), as a result of which the affixation of the target workpiece has remained at a minimum awkward and unnecessarily time consuming. Accordingly, in any implementation of the apparatus, the affixation of the workpiece to or at the workpiece holder is substantially simplified by configuring the workpiece holder to include a magnetic clamp that is judiciously structured to prevent the electrical contact between the slurry-containing liquid and the magnets, thereby avoiding any influence of the electrically-conducting components of the workpiece holder on electrochemistry of the slurry.

To this end, an embodiment of the apparatus of the invention includes—in addition to a table that is operably connected with a motor and a motor drive of the apparatus (and that is supported at a portion of a housing of the apparatus rotatably about an axis of rotation; the so-called CMP rotating table) and a carrier-chuck having a chuck head and a workpiece holder removably attached to the chuck head—a support component that contains a recess dimensioned as or forming a reservoir in the support component. The support component is removably carried by the table (and, is generally structured to carry and support ah adhesive-layer containing polishing pad used for polishing the workpiece, and for that reason is interchangeably referred to as a polishing pad holder). The apparatus is further equipped with the measurement system that includes a first electrode (which is electrically connected to at least the microcontroller of the apparatus through a slip-ring and which extends into the reservoir from an electrode-holder). Furthermore, the apparatus contains electronic circuitry including the potentiometer and the microcontroller configured to at least govern an operation of the table motor drive, to control force exerted by a component located within the carrier-chuck onto the workpiece holder, to collect measurement data acquired by the measurement system of the apparatus, and, in response to processing such measurement data, modify one or more of parameters of the polishing process.

Depending on the specifics of a particular implementation, the reservoir in the support component has a bottom facing the table and an opening facing the carrier chuck. Generally, the reservoir is dimensioned to have at least a portion that is rotationally-symmetric about the axis of rotation, and may come in either or both of the following incarnations: the one on the axis of rotation and the one dimensioned as a groove that is rotationally-symmetric about the axis of rotation. It will be appreciated, that geometry of the reservoir optionally satisfies the following conditions: when the reservoir or a portion of the reservoir is on the axis of rotation, such portion may have a volume defined by a cylinder, a polyhedron, or an irregularly shaped three-dimensional figure; and when the reservoir or a portion of the reservoir is a rotationally-symmetric groove, such groove is formed in a peripheral portion of the support component. In substantially any embodiment, the support component (the polishing pad holder) is electrically-insulating at least with respect to the table, and in a specific case the support component is shaped to be rotationally-symmetric about the axis of rotations. When the reservoir is shaped only as a groove, the apparatus may employ a polishing pad the extent of which in the up-facing surface of the supporting component does not exceed a diameter of the groove. Optionally—and in any implementation of the apparatus—the polishing pad may an outer perimeter and an inner perimeter that defines an opening in the polishing pad. Additionally or in the alternative—and in any implementation—the apparatus may be configured to satisfy one or more of the following conditions: an inlet of the reservoir is defined by a reservoir aperture such that the axis of rotation passes through the reservoir aperture or opening; the inlet of the reservoir is defined at a location of the up-facing surface that is between the axis of rotation and an outer edge of the support component; the inlet of the reservoir is between the outer perimeter of the polishing pad, operably positioned on and adhered to the up-facing surface of the support component, and the outer edge of the support component; and the opening in the polishing pad and the inlet of the reservoir overlap at least in part when the polishing pad is operably positioned on and adhered to the up-facing surface of the support component.

Alternatively or in addition—and in substantially any embodiment—the reservoir may have an opening or aperture through which the first electrode extends into the reservoir, while the measurement system may be connected to and/or include an additional electrode that either extends into the reservoir from the electrode holder through such opening or is firmly embedded in the reservoir. (This additional electrode is also coupled to the microcontroller and the potentiometer through the slip-ring and may be structured to be embedded in a wall of the reservoir or protrudes into the reservoir from the bottom and be fluidly-sealed in the reservoir at least with respect to the table.)

Substantially any embodiment of the apparatus may optionally include a working electrode (in the chuck head) that is electrically connected to the microcontroller and the potentiometer through a slip-ring and to a back surface of the workpiece when the workpiece is secured in the chuck head. In this case, the microcontroller may be additionally configured to receive a reading or signal provided at least by the additional electrode and to bias the working electrode and the additional electrode with respect to one another (for example, by applying an electric potential to the working electrode or to the slurry-containing liquid at a point of contact between the additional electrode with such liquid (in order to adjust a flow of current passing through the workpiece as defined by the first and working electrodes).

Optionally—and in any embodiment—the apparatus may be complemented with an acoustic sensor disposed in the chuck head and electrically connected with the microprocessor through the slip-ring (in which case the microprocessor may be additionally configured to receive the acoustic sensor signal that represents mechanical vibrations of a component of the apparatus during an operation of the apparatus, and to determine an eigenfrequency of such mechanical vibrations. Alternatively or in addition, the apparatus may include a piezoelectric element disposed in the chuck head and electrically connected to the microcontroller through a slip-ring (to decouple the operation of the piezo from the rotational movements during the process of polishing). In this case, the microcontroller may be additionally configured to perform one or more of the following actions: a) to adapt voltage applied to the piezoelectric element based at least in part on the measurement data collected by the measurement system of the apparatus; and b) when the eigenfrequency of the mechanical vibrations of the apparatus have been determined based on the signal received by the microcontroller from the acoustic sensor, to apply electrical pulses to the piezoelectric element at such a frequency as to substantially match the frequency of oscillation of the piezoelectric element with a resonant frequency of the mechanical vibration(s) of the apparatus, as a result of which an amplitude of a time-alternative force transferred from the piezoelectric element to the workpiece holder is increased. (To achieve this effect, for example, the piezoelectric element can be driven, with the use of the microprocessor, at a frequency that is within a +/−30% range, preferably within a +/−20% range, more preferably within a +/10% range, even more preferably within a +/−5% range, and most preferably within a +/−2% range from the eigenfrequency of such mechanical vibrations). When the piezoelectric element is present in the apparatus, at least one of the following conditions may be satisfied: the piezoelectric element is sandwiched between first and second electrically-insulating pads in the chuck head (as a result of which the chuck head includes an electrically-insulating plate or pad separating the piezo from the workpiece holder); the piezoelectric element is configured to have a tunable frequency of operation; and the piezoelectric element is dimensioned as a disk.

As was already alluded to above, at least one implementation of the apparatus may be optionally configured to incorporate a workpiece holder that includes a metallic plate while the electrically-insulating plate separating the piezo from the workpiece holder is cooperated with a magnetic clamp configured to (reversibly/removably) magnetically affix the chuck head and the metallic plate of the workpiece holder to one another. In one specific case, the magnetic clamp may include a plurality of magnets spatially coordinated with corresponding openings in the electrically-insulating plate such as to be inwardly recessed from a surface of this insulating plate that faces the metallic plate.

Alternatively or in addition, to complete the ease of the polishing process, any embodiment of the apparatus may include a port dimensioned to deliver the slurry-containing liquid towards an up-facing surface (and, when the polishing pad is installed in this up-facing surface—towards the polishing pad) through an outlet of such port. This liquid having a property of an electrolyte and possesses an ionic (ion-defined) conductivity. Furthermore, in any embodiment the workpiece holder (and with it—the workpiece, when affixed in such holder) can be made to rotate about a local axis, thereby adding another rotational motion to the rotation of the table about the axis of rotation of the table. To implement this, a rotary drive operably connected to the carrier-chuck and to the microprocessor can be provided, where the carrier-chuck may be rotatably connected to the rotary drive while the microprocessor may be configured to control the rotary drive to apply a pressure to the workpiece holder to force the workpiece holder towards the support component while, at the same time, rotating the workpiece holder about its local axis.

Among the parameters of the polishing process that may be modified, in real time, with the use of the electronic circuitry including the microprocessor, there may be the pressure applied to the workpiece holder via the rotary drive; the time-alternative pressure/force applied to the workpiece holder by the piezoelectric element to displace the workpiece along the axis of rotation and/or a corresponding electrical signal delivered to the piezoelectric element to cause such element to apply this time-alternating pressure/force to the workpiece holder; an ionic conductivity of the slurry-containing electrolytic liquid; and at least one of a spatial orientation parameter and a spatial position parameter of a component of the carrier-chuck with respect to the support component (which, in a specific case, may include a speed of rotation of the table and a speed of rotation of the workpiece holder).

BRIEF DESCRIPTION OF THE DRAWINGS

The invention will be more fully understood by referring to the following Detailed Description of Specific Embodiments in conjunction with the Drawings, of which:

FIGS. 8, 9, and 10 provide additional information representing structural and operational characteristics of an embodiment of the invention.

Figure 1:
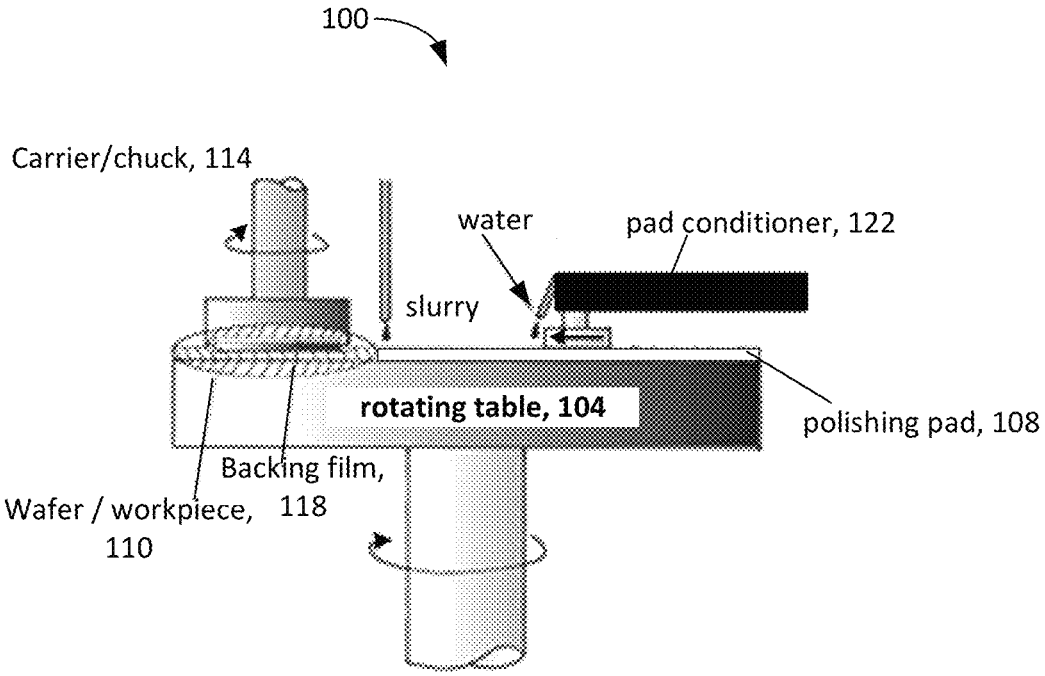
FIG. 1 (PRIOR ART)
FIG. 1 is a schematic diagram of a conventional CMP system structure.

Generally, the sizes and relative scales of elements in Drawings may be set to be different from actual ones to appropriately facilitate simplicity, clarity, and understanding of the Drawings. For the same reason, not all elements present in one Drawing may necessarily be shown in another.

DETAILED DESCRIPTION

Embodiments of a tool discussed in this disclosure provide a solution to a problem of real-time (in situ) assessment and/or monitoring of the electrochemical characteristic(s) of the slurry used in the CMP process by employing a judiciously configured potentiostat-including electronic circuitry to monitor such characteristic(s). In addition or alternatively, embodiments of the invention obviate shortcomings associated with insufficient control of the conventional CMP-process by providing a CMP-system (otherwise conventionally configured to complement a constant force, with which a workpiece that is being polished is weighted against the polishing pad) with a time-alternating (for example, pulsed) force and/or means for measuring an electrical characteristic of a electrolytic liquid containing abrasive particles (slurry or analyte, for short) used in the CMP-process. In one example, the time-alternating force is applied with the use of a vibrating component of the apparatus that is electrically insulated from the workpiece and that is disposed in the carrier-chick in which the workpiece is affixed for CMP-process, while the electrical characteristic of the slurry is measured with the use of a judiciously-structured reservoir in which the used slurry is collected.

For the purposes of this disclosure and accompanying claims, a real-time or in situ performance of a system is understood as performance that is subject to operational deadlines from a given event to a system's response to that event. For example, a real-time extraction of desired information (such as an electrical potential) from a material system subject to a certain treatment with the use of an appropriate measurement electronic circuitry may be one triggered by the user and executed simultaneously with and without interruption of a treatment process, performed on the material system, during which such information has been extracted and/or recorded.

As is discussed below in detail, an embodiment of the CMP apparatus of the invention is provided with the ability to monitor electrochemical characteristic(s) of the slurry used in the CMP process and generate an output representing such characteristic(s). (Such output may be further directed to an outside or built-in slurry-forming system for optional adjustment of the composition of the slurry as may be required, which may be carried out even substantially contemporaneously with the monitoring process.) To implement that the monitoring of the electrochemistry of the slurry, a CMP machine or machine is provided with a well or a reservoir, formed in in an electrically-insulating material plate in a judiciously-defined spatial coordination with the polishing pad, to collect the slurry that has participated in the workpiece polishing and for the two electrodes—one being the measurement electrode (that may be referred to as a counter electrode) and another being a reference electrode—to be submerged in or otherwise in contact with the so-collected analyte to empirically ascertain an electrical potential parameter representing contents of the reservoir. (These first and second electrodes are configured to operate in conjunction with another and with a working electrode that is in electrical contact with the back surface of the workpiece being polished during the CMP process to vary the flow of current passing through the workpiece and polishing slurry.)

Depending on the specific implementation, the slurry-collecting and electrode-hosting well or reservoir is placed either on the outside of the outer edge of the polishing-pad holder (the support component) or, alternatively or in addition, substantially in the center of the polishing-pad holder. The latter location provides several operational advantages: with such disposition of the reservoir, the overall structure of the CMP machine is made more compact and/or the radial extent of the rotating table and/or electrically-insulating support component or plate, thereby better accommodating the CMP machine for use as a benchtop tool. At the same time, as a skilled person readily recognizes, the central portion of the rotating table/polishing pad holder/polishing pad, in practice, remains substantially unused for polishing anyway (since in the central, axial area of a rotating polishing pad the linear velocity of rotation is lower than that at the outside of the pad)> Therefore, the use may be made of the portion of the machine that is necessarily present and generally not used in a conventionally-structured CMP machines, to increase the degree of utilization of the CMP apparatus. Furthermore, since the central area of the rotating table carrying the electrically-insulating support component/plate experiences lower centrifugal force, any physical impact that the counter and reference electrodes may be exposed to while submerged into the used sully collected in the reservoir formed in such central area is, naturally, reduced as compared to the situation in which these electrodes are positioned elsewhere with respect to the polishing pad. Moreover, due to the reduced value of the centrifugal force, the collected in the so-located reservoir slurry-liquid remains positionally stable in that it is substantially not forced to change the shape of its volume within the reservoir to balance the centrifugal force against the other forces acting upon such liquid (to put it simply, it substantially does not climb the walls of the reservoir), thereby ensuring that the measuring electrodes remain always submerged and preserving the integrity of the measurement process. To accommodate the use of a polishing pad with the so-structured CMP apparatus, a conventional polishing pad is also modified to include an aperture (opening) in its central portion.

On the other hand, structuring the slurry-collecting reservoir in a former location—that is, in a peripheral portion of the support component (pad-holder) and outside of the edge of the polishing pad—provides an operational advantage stemming from the naturally-occurring of outward casting of the slurry under the centrifugal force associated with the rotation of the table of the CMP machine. As a result, the measurement of the electrochemical parameters of the slurry/electrolyte at the outskirts of the polishing pad reflects the changes in this analyte that occurred more recently as compared with those reflected by the measurements undertaken on the slurry/electrolyte collected in the centrally-located reservoir (thereby resulting in a more precise and up-to-date and less stale data, so to speak).

To structure the CMP apparatus to properly secure and hold the workpiece during the polishing process while measuring the instantaneous electrochemistry of the used liquid(s), the carrier chuck holding the workpiece was appropriately structured to include materials that were non-electrically-conductive (thereby ensuring that only the sample/workpiece remains part of the electrical circuitry involving the measuring electrode) to not interfere with the electrochemical measurements. To this end, the layer of material (for example, a disk of ceramic material) of the workpiece-holding portion (interchangeably referred to as a workpiece-head or a wafer-head) of the chuck in contact with the workpiece was made non-electrically-conductive, while electrical pogo pins were arranged through this layer to establish electrical connection with the backside electrical contact (the working electrode) and to the workpiece. Optionally, high-strength magnets could be employed to mechanically couple the workpiece-holding portion of the chuck to the vibrating wafer head: removing and/or attaching the workpiece-holder from/to the chuck magnetically is more convenient for changing samples. Once removed, the free wafer-head (workpiece holder) can be cleaned, and the wafer/workpiece can be removed. Moreover, the adjustments to the height or, generally, orientation of the workpiece/wafer with respect to the wafer-head are therefore simplified. When employed, the magnets are intentionally inwardly recessed into the non-electrically-conducting layer of the workpiece-head to prevent electrical contact between the magnets and the backside of the workpiece during the polishing process, (which would otherwise modify the very electrical chemistry being measure and the potentiometer electrical circuitry performing such measurement).

In at least one case, at least one micro-pin can be added to the non-electrically-conducting layer of the wafer-head to help prevent rotation of the wafer/workpiece in the wafer-head as a result of the surface of the workpiece being engaged by a polishing pad during the CMP process. In at least on case, the workpiece-holder has a conductive adhesive or agent that is electrically-conductive and that is promotes holding the workpiece in place while establishing and maintaining operationally-good and reliable electrical contact between the workpiece holder and the backside of the workpiece.

To generate the pulsating pressure applied to the workpiece during the CMP process, the workpiece-holder is additionally equipped with a thin plate-like piezo-element disposed between the metallized on each side to impart pulses of force (pulsating pressure) that are controlled over a pre-determined range of frequencies to match the mechanical frequency of piezo vibrations to the electrical resonant drive frequency and to maximize the amplitude of the pulses applied to the workpiece during the CMP process. The piezo-element is complemented with appropriately-drawn electrical connections within the workpiece-holder configured to allow the carrier to freely rotate, and is electrically-connected to a pulse-generating electronic circuitry via a slip-ring to maintain a free rotation of the carrier about its axis. Additionally or in the alternative, the workpiece-holder may be complemented with a mechanical means to modify the resonant frequency of the chuck head. (In one implementation, such mechanical means includes appropriately configured shims and/or a capture ring.) Overall, the electrical connections between the chuck and/or chuck head and electronic circuitry with a processor that is configured to govern the operation of the CMP machine (which is now enhanced with the electrochemistry-monitoring and pulse-applying capabilities, as alluded to above) are dimensioned and/or structured as a multi-channel electrical-connection path. This multi-channel electrical connection includes at least the working electrode (in contact with the bask surface of the wafer/workpiece), electrodes of the piezo-element, and those associated with operation of the acoustic sensor are drawn through the slip ring (or slip rings, as the specifics of the design may require) to avoid the situation of twisting and eventual breakage of the related electrically-conducting members upon the rotational motion of the wafer head, as discussed in this disclosure. At the same time, the first and second electrodes (that are submerged into the slurry/analyte accumulating in a reservoir during the CMP process do not require the use of the slip ring.

Embodiments of the invention include the use of an acoustic sensor, disposed in the wafer head (interchangeably referred to as a workpiece holder) in operable communication with the piezo-element and the wafer/workpiece and configured to measure the operational status of the CMP machine to adjust the roughness of vibrations imparted on the wafer/workpiece by the piezo-element operating in the pulsed regime. While the choice of an acoustic sensor for this purpose may not be obvious for a person of skill in the art, the process of monitoring of the polish quality (roughness) need to use the high-frequency sensor with range up to at least 1 MHz and preferably up to 5 MHz (considering that the frequency bandwidth of a typical piezo-element is within the approximately 60 kHz range, the cut-off frequency of the sensor responsible for such monitoring should be substantially higher than the cut-off mechanical frequency of the piezo.) The adjustment of the frequency of the operation of the piezo-element during the CMP process, based on the readings provided by the acoustic sensor, is performed with the use of shims and a capture ring dedicated for this purpose in the wafer head (or, wafer holder) unit. Upon tuning the frequency of operation of the piezo towards an eigenfrequency of a vibration of the CMP apparatus, the CMP process is performed with the higher amplitude of the piezo-element vibrations.

Figure 2:
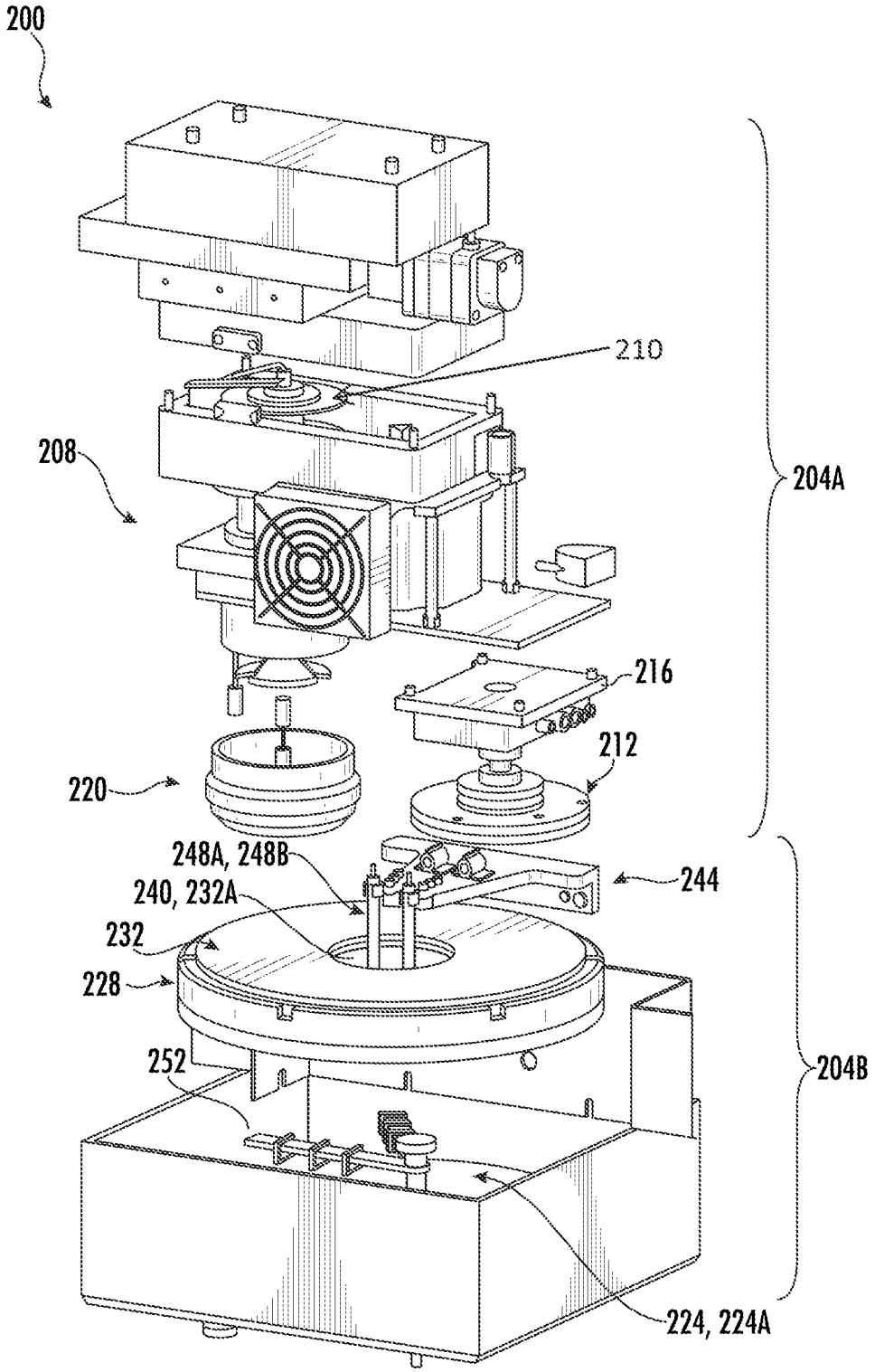
FIG. 2 is an exploded view diagram of an embodiment of the CMP machine of the invention.

Turning now to FIG. 2, an embodiment 200 of the invention is schematically illustrated in the expanded view to include an upper assembly 204A that contains at least the upper rotary drive 208), a conditioner unit 212 operably connected to the upper rotary drive through the corresponding force sensor 216 and freely rotating during the operation of the embodiment, and a vibration wafer head (workpiece head, workpiece holder) 220. The upper assembly 204A may additionally include the (optionally programmable) electronic circuitry with a microprocessor that is, as discussed elsewhere in this disclosure, is configured to be at least electrically connected to and govern the operation of various components and elements and sub-systems of the apparatus 200 as well as to collect measurement data collected in situ by measurement means of the apparatus. Alternatively, such electronic circuitry and/or microprocessor block can be arranged as a block external to the CMP apparatus. Component 210 includes a slip ring configured to implement multi-channel electrical connections of the embodiment 200.

In the lower portion or assembly 204B of the embodiment 200, there is a CMP rotating table 224 with the upper surface 224A (which table is supported in the respective portion of the housing of the apparatus 200 rotatably about the axis of rotation of the table). The table 224 is operably cooperated with the corresponding drive/motor (may not be shown in FIG. 2) that is configured for rotating the table 224 about the rotation axis and connected to the microprocessor to have the process of rotation initiated/interrupted/modified. Optionally, the table 224 includes an adaptor/mounting ring. The table 224 is dimensioned to carry the removable insulator spacer plate (also referred to as a support component or polishing-pad holder) 228. In preparation to polishing the target workpiece, the user would removably affix the target workpiece in the workpiece holder 220 and adhere a polishing pad 232 to the up-facing surface of the support component 228. The rotary drive 208 may additionally include a mechanism that is used to apply, in operation of the apparatus 200, a substantially constant force to the workpiece holder 220 downwardly, towards the rotatably-supported table 224 and the polishing pad 232, and that is appropriately structured as known in the art.

The pad holder 228 is formed to include the electrically-insulating material (to make the pad holder 228 be electrically-insulating at least with respect to the table 224). The pad holder 228 is structured to include a reservoir 240 for collecting the used slurry. The reservoir may generally be located on the outside of a line representing a boundary of the polishing pad 232 when the polishing pad 232 is adhered to the up-facing surface of the component 228. Notably, the polishing pad 232 can be shaped differently—in non-limiting examples, it can be shaped as a circle or as a ring. The embodiment presented in FIG. 2 illustrates a specific example of the component 228 with the reservoir 240 in the central axial portion of the component 228, and a specific example of the polishing pad 232 that is ring-like—that is, having an outer diameter and an inner diameter (with the inner diameter defining an aperture of or opening 232A in the pad 232). The aperture-containing pad 232 is used, understandably, when the support component 228 is structured to have the reservoir 240 located in the central portion of the support component 228. In this case, when adhered to the component 228, the aperture of the polishing pad 232 and the inlet/opening of the reservoir and is spatially-coordinated with—that is, at least partially overlapping with—the pad aperture or opening 232A).

It is appreciated that, in addition or alternatively to forming the reservoir in the central portion of the support component 228 as shown in the embodiment 200, the reservoir may be formed in the peripheral area of the component 228 that is not covered by the polishing pad when the pad is introduced. In this case it is preferred to dimension such reservoir as a groove that is rotationally-symmetric about the axis of rotation of the table 224. In a specific case, an inlet leading to the reservoir may be located somewhere at an intermediate radial location of the support component 228 between the outer edge and the center of the component 228. In related and non-mutually-exclusive implementations, a version of the reservoir may optionally be structured to have a volume defined by a cylinder, a polyhedron, or an irregularly shaped three-dimensional figure. Generally, however, such a reservoir is dimensioned to have at least a portion of the reservoir that is rotationally symmetric about the axis of rotation.

As shown in this specific example 200, the electrode assembly (holder) 244 holds/supports first and second electrodes 248A, 248B (one of which is a counter electrode and another is a reference electrode) in such an orientation that the ends of the electrodes 248A, 248B reach into the volume of the reservoir 240 through the opening 232A in the polishing pad 232. One of these electrodes (a counter electrode) may be formed from graphite or platinum or, generally any other appropriate material to form a portion of electrical circuitry with the working electrode of the workpiece to pass current through the workpiece and the slurry. The function of another electrode—the so-called reference electrode—is to probe and/or apply an electrical potential at a point of contact with the slurry. Both the first and second electrodes 248A, 248B are operably connected to the programmable processor and/or electronic circuitry of the system governing the operation of the CMP machine to form a circuit with a working electrode of the CMP machine electrically-reaching out to and in electrical contact with the back surface of the wafer/workpiece to vary the flow of current passing through the workpiece and polishing slurry.)

In a related embodiment, one of the electrodes 248A, 248B—for example, the reference electrode—may be embedded in a wall of the reservoir or protrude into the reservoir from the bottom (in which case it should be fluidly-sealed in the reservoir at least with respect to the table 224. IN this case, as a skilled artisan will readily appreciate, it is preferred that the electrical connection between such version of the electrode and the electrical circuitry with the microprocessor and potentiometer of the apparatus is established through the slip-ring Continuing with FIG. 2, fluid port(s) 252 is/are coordinated to have its/their input end(s) fluidly connected to a slurry pump (not shown) and output end(s) above the surface of the polishing pad 232 (when the pad is positioned on the pad holder 228) to deliver electrolyte/slurry to the abrasive upper surface of the pad 232 during the operation of the system 200. The lower portion 204B may be disposed in the appropriately-dimensioned tray equipped with fluid inlet(s)/outlet(s).

Figure 3A:
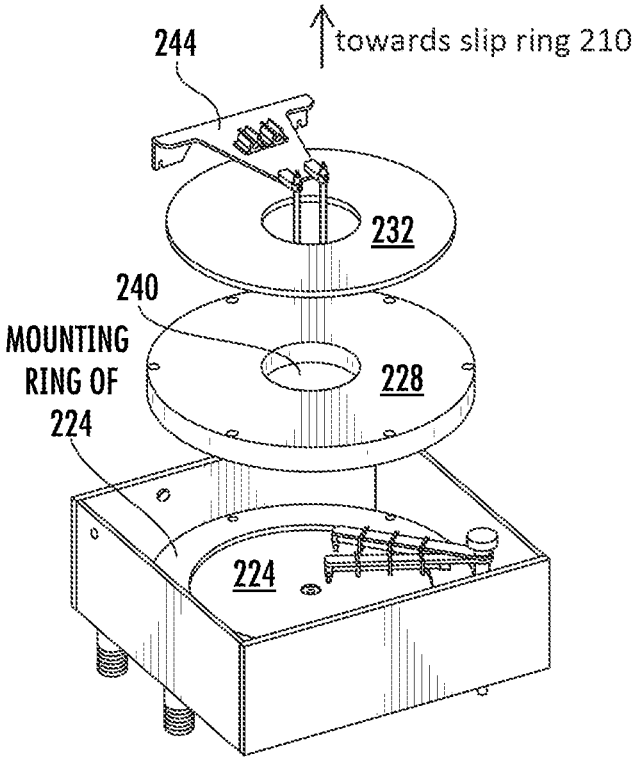
FIGS. 3A, 3B, 3C provide schematic illustrations of the lower portion of the embodiment of FIG. 2 in different views.
Figure 3B:
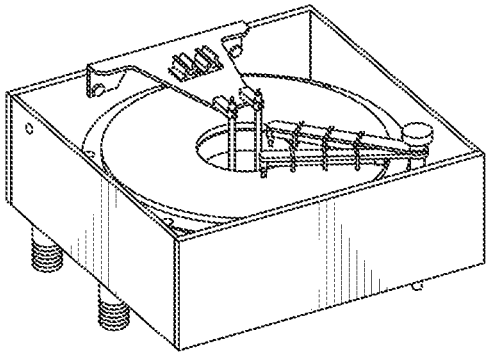
Figure 3C:
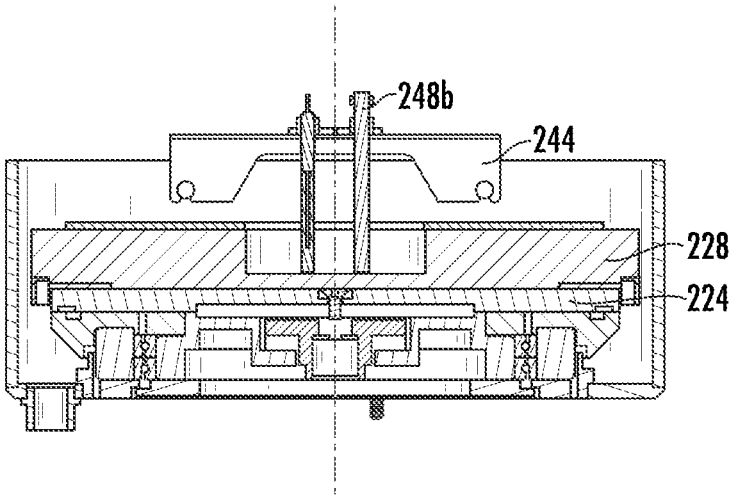

FIGS. 3A, 3B, and 3C present, respectively, a close-up expanded view, a perspective view, and a cross-sectional view lower portion 204B of the embodiment 200, in which the polishing pad 232 has been already inserted/installed for initiation of the polishing process.

Figure 4A:
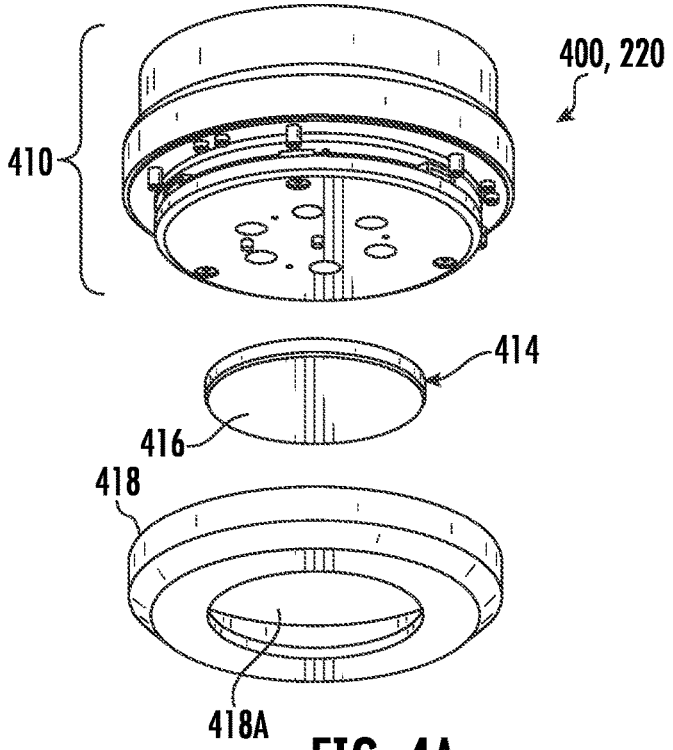
FIG. 4A is a diagram illustrating an embodiment of a wafer-head of the CMP machine configured according to the idea of the invention.
Figure 4B:
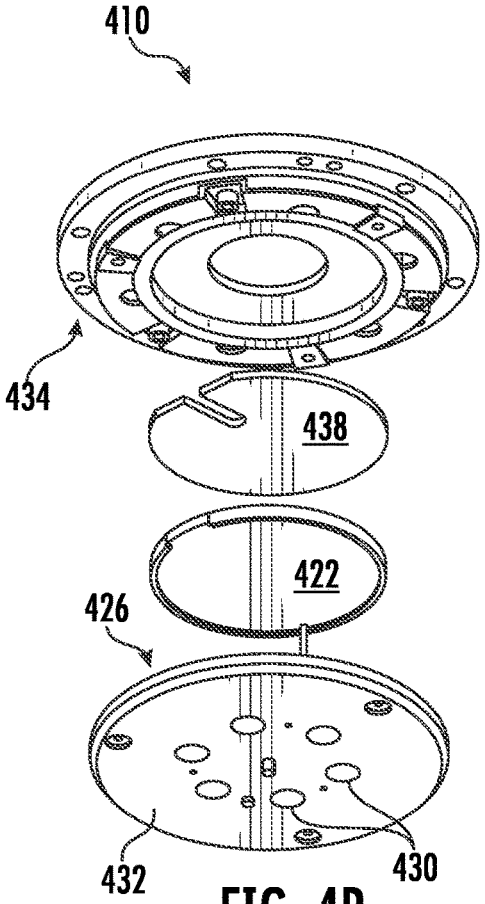
FIGS. 4B and 4C are, respectively, schematics of a piezo-transducer assembly portion and of a structure of a wafer-holder of the wafer-holder of FIG. 4A.
Figure 4C:
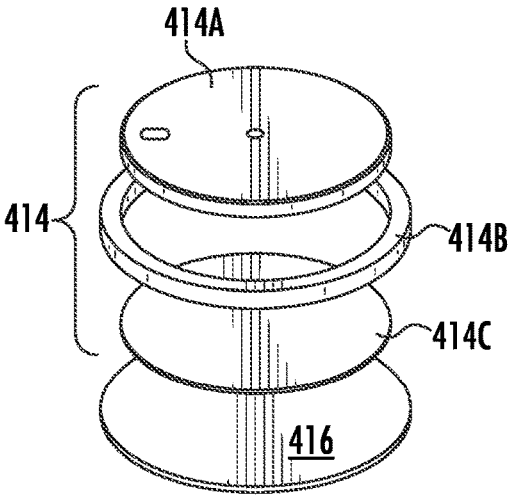

An expanded view of an embodiment 400 of the wafer/workpiece head 220 is shown in FIG. 4A, with the piezo-transducer section or unit 410, the wafer/workpiece holder 414 (shown with the wafer/workpiece 416 affixed therein) that is magnetically attached to and carried underneath the unit 410, and a practically-useful snap-on plastic cover 418 (through the central opening 418A of which the wafer/workpiece is exposed towards the polishing pad 232 during the operation of the embodiment). FIG. 4B provides the expanded view of the embodiment of the piezo-transducer unit or assembly 410, specifically detailing the location of the piezo-element 422 (that is electrically-connected to the electronic circuitry of the CMP system and/or programmable processor and/or power drive via a slip ring connector, as discussed above) and the magnetic clamp 426 configured for magnetically-holding/fixating the wafer holder element 414 underneath, as discussed elsewhere in this application (the magnets of the clamp 426, not shown in this Figure, are disposed inwardly recessed in the apertures 430 of the ceramic disk 432 and face the wafer holder 414). The magnetic clamp 426 may include the so-called locating pins that, when mated with the wafer/workpiece, are used to prevent the wafer from slipping during the operation of the CMP apparatus. The piezo-element 422 is separated from the base 434 of the wafer head 220 with the insulating layer 438. In reference to FIG. 4C, the components of the wafer/workpiece holder 414—that may include, in one implementation, a plate 414A of magnetic electrically-conducting material with through holes (at the peripheral portion of the plate 414, for example; illustrated as 510A, 510B in FIG. 5B) that are intentionally created to spatially-match with locating pins at the magnet clamp 426, a rubber sealing ring 414B, and a layer of conductive adhesive 414C providing electrical contact between the plate 414A and the back-side of the wafer 416, are shown in FIG. 4C.

Figure 5A:
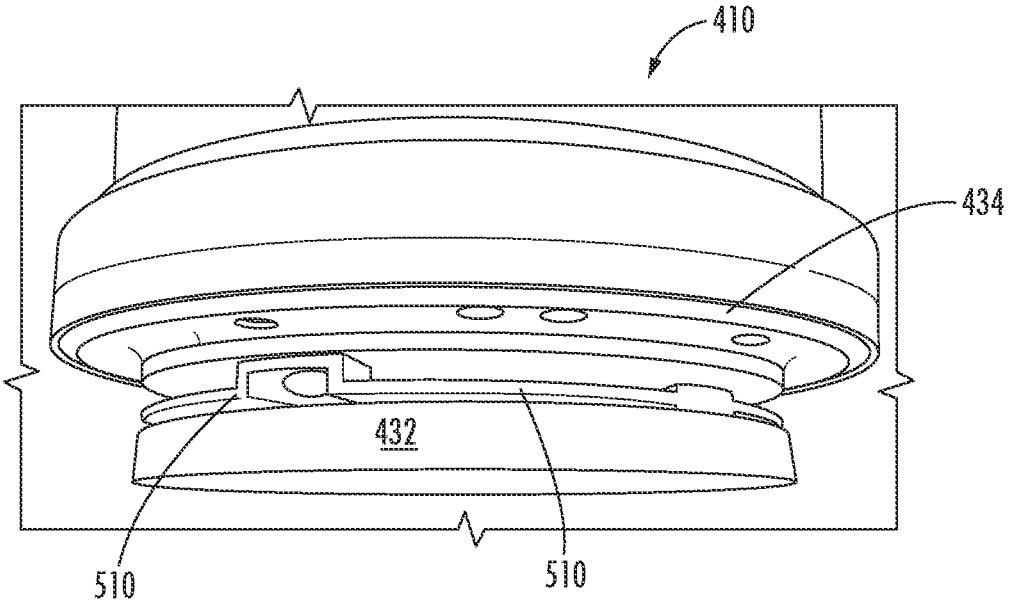
FIGS. 5A, 5B are close-up views of the structures of FIGS. 4B and 4C, respectively.
Figure 5B:
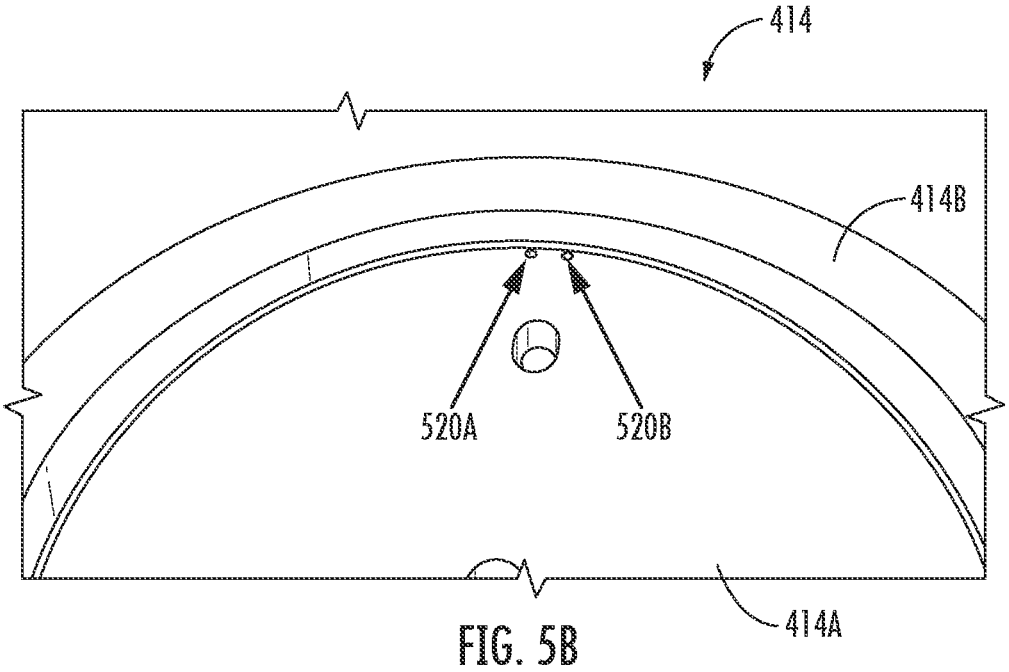

FIGS. 5A, 5B present, respectively, a close-up views of the assemblies 410, 414. In FIG. 5A, a clamp frame 510 (which has a substantially the same foot-print as that of the ceramic disk 432 and appropriately structured for adjusting stiffness of the structure of the unit 410, to tune the mechanical resonant frequency of vibration of the head 400, 220) is shown mechanically cooperated with and attached to the base 434. FIG. 5B illustrates the holes 520A, 520B for locating pins of the magnetic clamp 426 to go through towards the wafer/workpiece.

Figure 6:
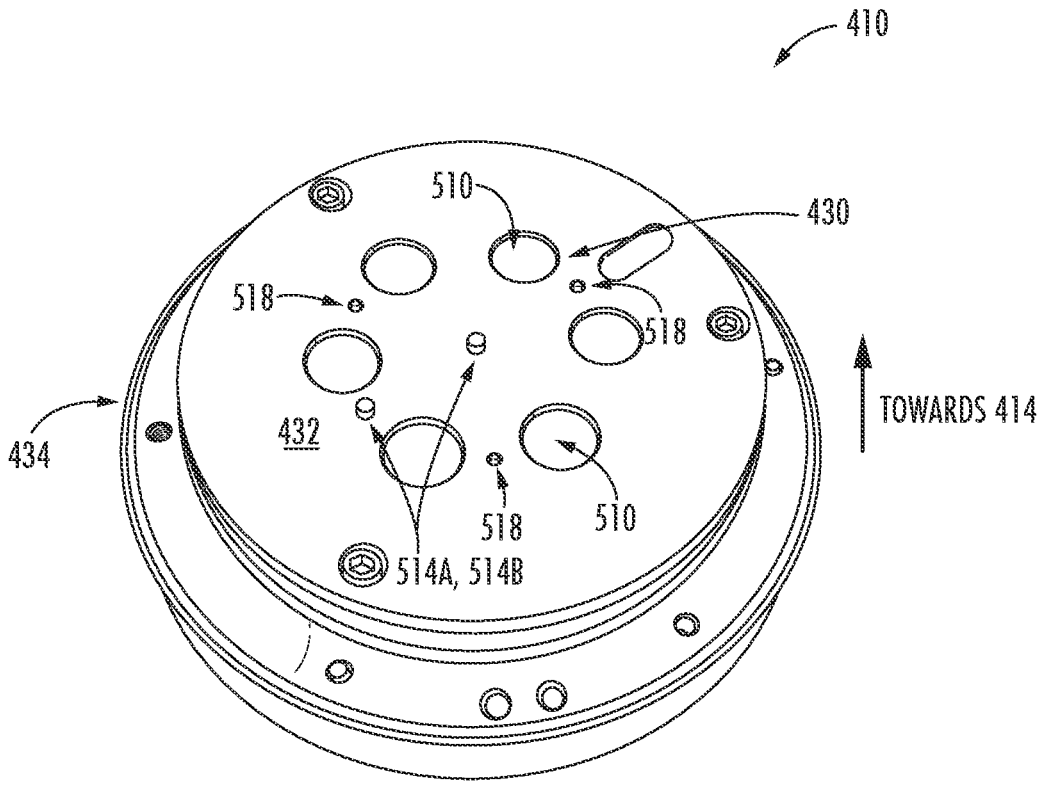
FIG. 6 illustrates a portion of the CMP system assembly containing a magnetic clamp configured for securing the wafer or workpiece.

FIG. 6 provides an additional perspective view of the assembly 410 illustrating the magnetic clamp 426, in which the magnets 510 are positioned such as to have their surfaces facing the workpiece holder 414 be below the level of (inwardly recessed with respect to) the outer surface of the electrically-insulating plate 432 to prevent electrical contact between the magnets and a portion of the system (such as the plate 414A) that is in electrical contact with the wafer or workpiece and to avoid the inadvertent and unintended electrical modification of the chemistry of the slurry and the operation of the potentiometer measurement system involving the electrodes of the system that would occur if such electrical contact were present during the operation. At the same time, the pogo pins 518—operating as a group of pins, aggregately—are configured to do exactly the opposite—to establish and provide the electrical contact between the reference electrode 248A and the back side of the wafer/workpiece (via the plate 414A and the working electrode). Pins 514A, 514B protruding through the disk 432, are alignment pins dimensioned for centering the wafer holder unit 414 (the central pin 514B) and transferring the torque (the outer pin 514A).

Figure 7A:
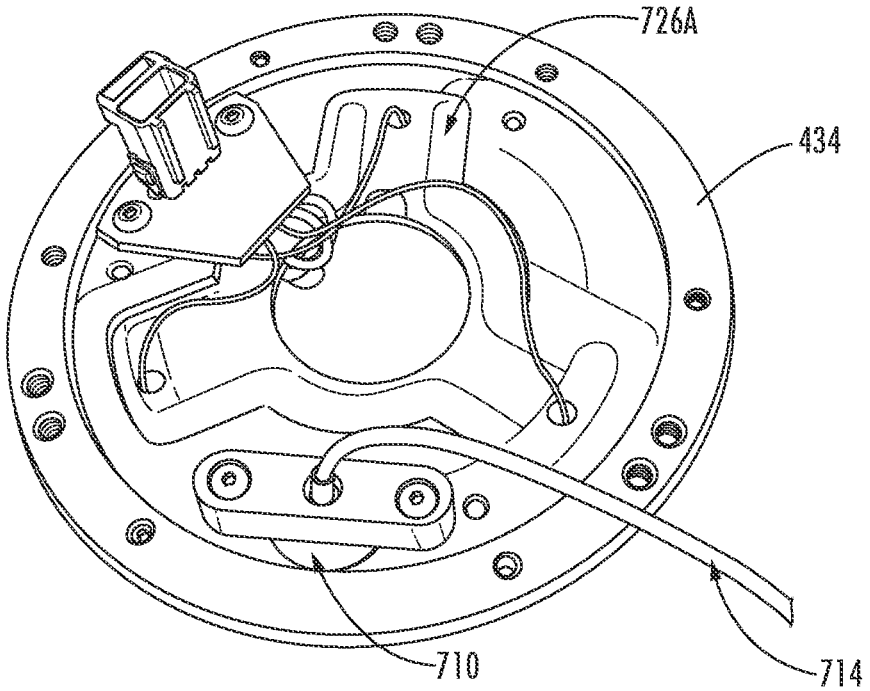
FIGS. 7A, 7B illustrate the cooperation between the acoustic sensor and the base on the wafer-head portion of the system.
Figure 7B:
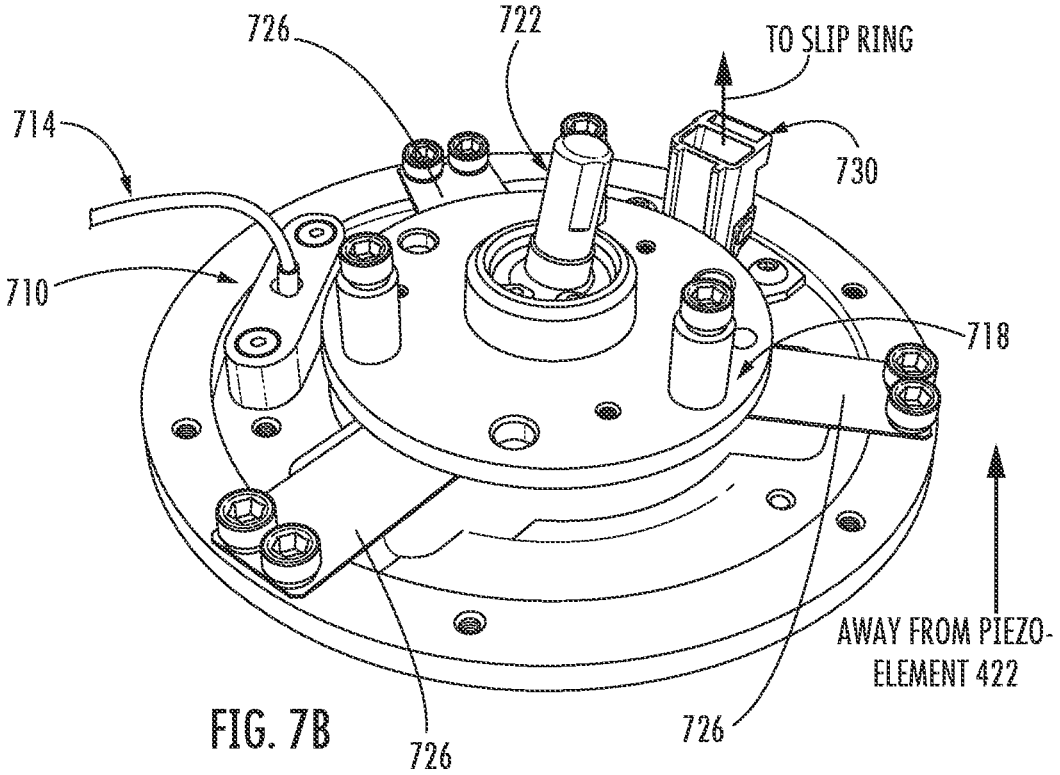

FIGS. 7A and 7B illustrate the positioning of an acoustic sensor 710 within the wafer head or workpiece head subsystem 400—and, specifically, in mechanical cooperation with the outer surface of the base 434. The lead or electrode 714 of the acoustic sensor 710 is electrically-connected to the electronic circuitry/programmable processor of the CMP system intentionally via the slip ring, as was discussed elsewhere. In practice, the process of measuring the surface figure (for example, roughness) of the wafer with the acoustic sensor may be timed between the moments when the signal feeding the piezo-element 422. In the diagram of FIG. 7B, the base holder 718 with the ball joint bearing 722 is additionally illustrated, in order to provide the reader with more clear understanding of the mechanical connections involved. The purpose of the ball joint bearing 722 is to ensure parallelism of the mutual orientation of the wafer and the polishing pad to produce uniform polishing and avoid spatial deviations that result in the polished surface being non-planar (the so-called "hot spots", as they are known in the art). The optional spring element 726 (shown here in a group of three) is configured to account for and facilitate mechanical compensation for uneven spatial distribution of the polishing pad 232 (the deviations from the planar surface) in the polishing pad, to achieve the desired goal during the polishing procedure. The grooves 726A (shown in the base 434 in FIG. 7A) are dimensioned to accommodate these spring elements 726. The plug 730 provides electrical connectors leading to the piezo-element 422 and the working electrode of the wafer/workpiece.

Figure 11:
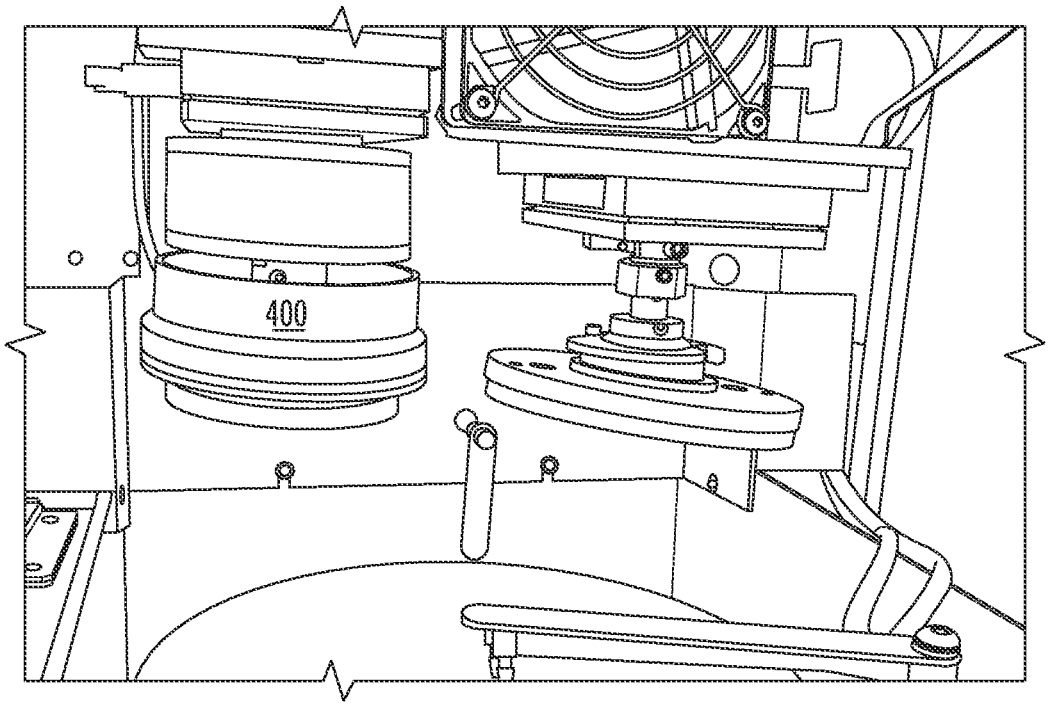
FIG. 11 illustrates a portion of the CMP apparatus.
Figure 8:
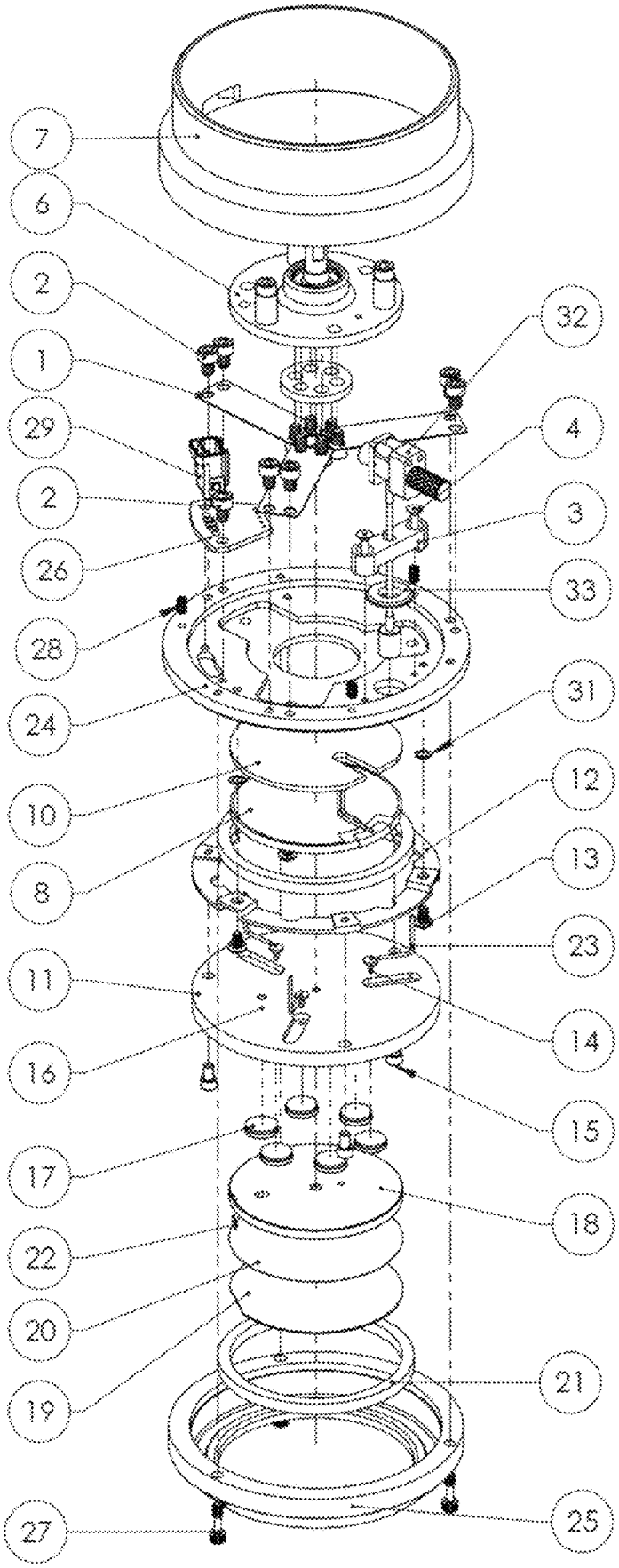
Figure 10:
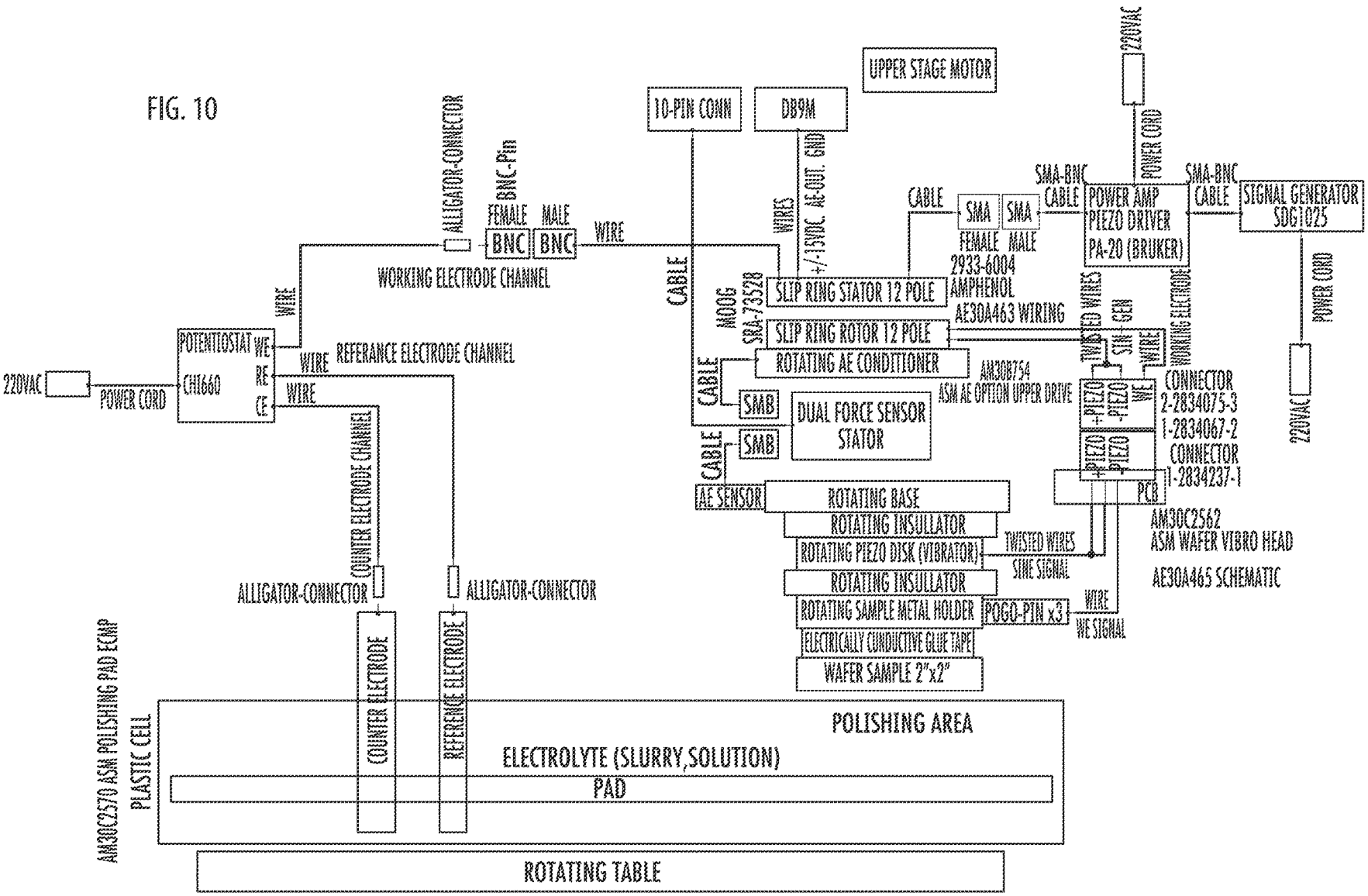

To complement and expand the above description of hardware of an embodiment of the CMP machine, FIG. 11 illustrates a portion of the CMP apparatus; FIG. 8 illustrates, in the expanded view, the minute details and multiple structural components of the wafer head 400 while FIG. 9 provides a technical specification for assembly of such wafer head (the numerals and labels used in FIGS. 8 and 9 correspond to one another and are used in connection with these Figures only). FIG. 10 provides a diagram illustrating at least some of electrical/mechanical connections of the embodiment of the invention.

In accordance with examples of embodiments, described herein, a CMP system is provided that is configured to polish a workpiece to which pulsed force is applied while, simultaneously, carrying out the measurement of electrochemical status of the used slurry/electrolyte to improve the quality of the polishing process. In that, the involved components of the CMP system are appropriately electrically connected to a potentiostat-type control and measuring device built around the provided electronic circuitry of the CMP system.

Whether explicitly stated or not, and whether expressly so indicated in the Drawings, embodiments of the CMP system of the invention include an optionally-programmable processor (microprocessor) and/or dedicated electronic circuitry controlled by instructions stored in a memory. The memory may be random access memory (RAM), read-only memory (ROM), flash memory or any other memory, or combination thereof, suitable for storing control software or other instructions and data. Some of the functions performed by such electronic circuitry/processor are those governing the operation of the CMP system and defining the processing regimes; and acquisition of processing data representing such operation and measurement data representing the electrochemical parameters of the analyte (slurry/electrolyte) used during the CMP process. Those skilled in the art should readily appreciate that such functions may be implemented as computer program instructions, software, hardware, firmware or combinations thereof. Those skilled in the art should also readily appreciate that instructions or programs defining the functions of the present invention may be delivered to a processor in many forms, including, but not limited to, information permanently stored on non-writable storage media (e.g. read-only memory devices within a computer, such as ROM, or devices readable by a computer I/O attachment, such as CD-ROM or DVD disks), information alterably stored on writable storage media (e.g. floppy disks, removable flash memory and hard drives) or information conveyed to a computer through communication media, including wired or wireless computer networks. In addition, while the invention may be embodied in software, the functions necessary to implement the invention may optionally or alternatively be embodied in part or in whole using firmware and/or hardware components, such as combinatorial logic, Application Specific Integrated Circuits (ASICs), Field-Programmable Gate Arrays (FPGAs) or other hardware or some combination of hardware, software and/or firmware components. A skilled artisan will readily appreciate from this disclosure that mutually-non-exclusive examples of how the microprocessor of the CMP-apparatus is configured and/or programmed include, without limitations, configuration(s) to at least govern an operation of the drives/motors of the apparatus; to control force exerted onto the workpiece holder of the apparatus; to collect measurement data acquired by a measurement system of the apparatus; to modify one or more of parameters of the polishing process in response to processing the collected measurement data, to receive a reading provided at least by the additional electrode and to bias the working electrode with respect to the additional electrode by applying an electric potential to the working electrode such as to adjust a flow of current passing through the workpiece; to receive a signal from the acoustic sensor representing mechanical vibrations of a component of the apparatus during an operation of the apparatus and to determine an eigenfrequency of such mechanical vibrations; to adapt voltage applied to the piezoelectric element based at least in part on collected measurement data; and when the eigenfrequency of the mechanical vibrations of the apparatus have been determined based on the signal received by the microcontroller from the acoustic sensor, to apply electrical pulses to the piezoelectric element at a frequency a value of which is within a pre-determined range (for example, +/−30% range or within a +/−20% range or within a +/10% range or within a +/−5% range) from the eigenfrequency of the mechanical vibrations to increase an amplitude of a time-alternating force transferred from the piezoelectric element to the workpiece holder).

As a skilled artisan will readily appreciate, now having the advantage of this disclosure, with the use of such microprocessor/electronic circuitry, an embodiment of the method for chemical-mechanical polishing of a workpiece may be carried out with the above-discussed CMP apparatus. The method is characterized at least in that it may include the use of the apparatus as discussed above; and, additionally, a step of positioning the support component (the polishing pad holder) on the rotatable table of the apparatus; an optical step of securing the workpiece in the workpiece holder of the apparatus with the use of the magnets of the magnetic clamp; and a step of polishing the workpiece by rotating the support component and the polishing pad adhered to the up-facing surface thereon on the table about the axis of rotation with respect to the workpiece while the workpiece is in contact with the polishing pad, and b) delivering the slurry-containing liquid to the polishing pad. During the process of polishing the workpiece, an optional step of electrically-biasing one of the working electrode and the additional electrode with respect to another based on an electrical parameter/reading acquired by the measurement system of the apparatus—from a combination of the first electrode and the additional electrode in contact with the slurry-containing liquid and the working electrode electrically-connected to the back side of the workpiece secured in the workpiece holder—may be performed to change an ionic conductivity of the slurry-containing liquid to affect the efficiency of the chemical component of the polishing process. Moreover, optionally at least one of a speed of rotation of the table and a speed of rotation of the workpiece holder may be also adjusted (which preferably—but not necessarily—can be carried our while the polishing process is continued). Here, any embodiment of the method may be characterized in that the method further include applying a pulsed pressure (during the step of rotating) to the workpiece in the direction of the polishing pad by delivering electrical pulses through the slip-ring from a signal generator of the electrical circuitry to the piezoelectric element contained in the carrier chuck. Alternatively or in addition, such embodiment may be characterized in that when apparatus includes an acoustic sensor configured s discussed above, the method further accommodates (during the process of rotating the support component) i) measuring an eigenfrequency of mechanical vibrations of the apparatus with the acoustic sensor when no voltage is applied to the piezoelectric element and ii) adjusting the frequency of the electrical pulses, delivered through the slip ring to the piezoelectric element, to the eigenfrequency of the apparatus within a predetermined range of values (such as +/−20%, or +/−10%, or +/−5%, or even +/−1% of a value of the eigenfrequency) based on the results of measurement performed by the measurement system of the apparatus.

For the purposes of this disclosure and the appended claims, the use of the terms "substantially", "approximately", "about" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "essentially", "to great or significant extent", "largely but not necessarily wholly the same" such as to reasonably denote language of approximation and describe the specified characteristic or descriptor so that its scope would be understood by a person of ordinary skill in the art. In one specific case, the terms "approximately", "substantially", and "about", when used in reference to a numerical value, represent a range of plus or minus 20% with respect to the specified value, more preferably plus or minus 10%, even more preferably plus or minus 5%, most preferably plus or minus 2% with respect to the specified value. As a non-limiting example, two values being "substantially equal" to one another implies that the difference between the two values may be within the range of +/−20% of the value itself, preferably within the +/−10% range of the value itself, more preferably within the range of +/−5% of the value itself, and even more preferably within the range of +/−2% or less of the value itself.

The use of these terms in describing a chosen characteristic or concept neither implies nor provides any basis for indefiniteness and for adding a numerical limitation to the specified characteristic or descriptor. As understood by a skilled artisan, the practical deviation of the exact value or characteristic of such value, element, or property from that stated falls and may vary within a numerical range defined by an experimental measurement error that is typical when using a measurement method accepted in the art for such purposes.

While the invention is described through the above-described exemplary embodiments, it will be understood by those of ordinary skill in the art that modifications to, and variations of, the illustrated embodiments may be made without departing from the inventive concepts disclosed herein. Furthermore, disclosed aspects, or portions of these aspects, may be combined in ways not listed above. Accordingly, the invention should not be viewed as being limited to the disclosed embodiment(s).

What is claimed is:

1. A chemical-mechanical-polishing apparatus for polishing a workpiece, the apparatus comprising:

a table that is operably connected with a motor and a motor drive of the apparatus, and that is supported at a portion of a housing of the apparatus rotatably about an axis of rotation;

a carrier chuck having a chuck head and a workpiece holder removably attached to the chuck head, a support component removably carried by the table, said support component having a recess that forms a reservoir therein;

an electronic circuitry including a potentiometer and a microcontroller configured to at least govern an operation of the motor drive, to control force exerted by a first component located within the carrier chuck onto the workpiece holder, to collect measurement data acquired by a measurement system of the apparatus, and, in response to processing such measurement data, modify one or more of parameters of said polishing;

and the measurement system of the apparatus that includes a first electrode, wherein the first electrode is electrically-connected at least to the microcontroller through a slip-ring and wherein the first electrode extends into the reservoir from an electrode-holder.

2. The apparatus according to claim 1, wherein the support component is configured to receive, at an up-facing surface thereof, a polishing pad with an adhesive layer.

3. The apparatus according to 1, wherein said reservoir has a bottom facing the table and an opening facing the carrier chuck, said reservoir being dimensioned to have at least a portion thereof that is rotationally symmetric about the axis of rotation, said reservoir being centered on the axis and/or dimensioned as a rotationally-symmetric groove.

4. The apparatus according to claim 3, wherein one of the following conditions is met:

A) the reservoir has a volume defined by a cylinder, a polyhedron, or an irregularly shaped three-dimensional figure; and B) said rotationally-symmetric groove is in a peripheral portion of the support component while the polishing pad is dimensioned to be positioned within said groove when the polishing pad is operably attached to an up-facing surface of the support component.

5. The apparatus according to claim 1, wherein the support component is rotationally-symmetric about the axis of rotation and/or is electrically-insulating with respect to at least the table.

6. The apparatus according to claim 5, wherein one or more of the following conditions is satisfied:

A) an inlet of the reservoir is defined by a reservoir aperture such that the axis of rotation passes through the reservoir aperture;

B) the inlet of the reservoir is defined at a location of an up-facing surface of the support component, wherein said location that is between the axis of rotation and an outer edge of the support component;

C) the inlet of the reservoir is between the outer perimeter of the polishing pad, operably positioned on and adhered to the up-facing surface of the support component, and the outer edge of the support component; and D) an opening in the polishing pad and the inlet of the reservoir overlap at least in part when the polishing pad is operably positioned on and adhered to the up-facing surface of the support component.

7. The apparatus according to claim 2, wherein the polishing pad has an outer perimeter and an inner perimeter that defines an opening in the polishing pad.

8. The apparatus according to claim 1, wherein the reservoir has an opening and said first electrode extends into the reservoir through such opening, and wherein the measurement system includes an additional electrode that either extends into the reservoir from the electrode holder through such opening or is firmly embedded in the reservoir.

9. The apparatus according to claim 8, wherein the additional electrode is coupled to the microcontroller and the potentiometer through the slip-ring and A) is embedded in a wall of the reservoir or protrudes into the reservoir from the bottom; and B) is fluidly-sealed in the reservoir at least with respect to the table.

10. The apparatus according to claim 8, comprising a working electrode in the chuck head, said working electrode electrically connected to the microcontroller and the potentiometer through the slip-ring and to a back surface of the workpiece when the workpiece is secured in the chuck head, wherein the microcontroller is configured to receive a reading provided at least by the additional electrode and to bias the working electrode with respect to the additional electrode by applying an electric potential to the working electrode to adjust a flow of current passing through the workpiece.

11. The apparatus according to claim 1, wherein said chuck head includes an acoustic sensor disposed therein and electrically connected with the microcontroller through the slip-ring, wherein the microcontroller is configured to receive a signal from the acoustic sensor representing mechanical vibrations of a component of the apparatus during an operation of the apparatus and to determine an eigenfrequency of said mechanical vibrations.

12. The apparatus according to claim 11, comprising a piezoelectric element disposed in the chuck head and electrically connected to the microcontroller, wherein the microcontroller is configured to perform one or more of the following:

A) to adapt voltage applied to the piezoelectric element based at least in part on said measurement data; and B) when the eigenfrequency of the mechanical vibrations of the apparatus have been determined based on the signal received by the microcontroller from the acoustic sensor, to apply electrical pulses to the piezoelectric element at a frequency value of which is within a +/−30% range or within a +/−20% range or within a +/−10% range or within a +/−5% range from the eigenfrequency of said mechanical vibrations to increase an amplitude of a time-alternating force transferred from the piezoelectric element to the workpiece holder.

13. The apparatus according to claim 11, further comprising a piezoelectric element disposed in the chuck head and electrically connected to the microcontroller, wherein one or more of the following conditions is satisfied:

A) said piezoelectric element is sandwiched between first and second electrically-insulating pads in said chuck head;

B) said piezoelectric element is configured to have a frequency of operation thereof tunable; and C) said piezoelectric element is dimensioned as a disk.

14. The apparatus according to claim 11, further comprising a piezoelectric element disposed in the chuck head and electrically connected to the microcontroller, wherein said chuck head includes an electrically-insulating plate separating said piezoelectric element from the workpiece holder.

15. The apparatus according to claim 14, wherein said workpiece holder includes a metallic plate and said electrically-insulating plate incorporates a magnetic clamp configured to reversibly magnetically affix said chuck head and said workpiece holder to one another.

16. The apparatus according to claim 15, wherein said magnetic clamp includes a plurality of magnets spatially coordinated with corresponding openings in the electrically-insulating plate such as to be inwardly recessed from a surface of said electrically-insulating plate that faces the metallic plate.

17. The apparatus according to claim 1, comprising at least one port dimensioned to deliver a slurry-containing liquid towards an up-facing surface through an outlet of said at least one port, said liquid including an electrolyte.

18. The apparatus according to claim 17, further comprising a rotary drive operably connected to the carrier chuck and to the microcontroller, the carrier chuck being rotatably connected to the rotary drive, the microcontroller being configured to control the rotary drive to apply a pressure to the workpiece holder to force the workpiece holder towards the support component, wherein the parameters of polishing include at least one or more of:

A) the pressure applied to the workpiece holder via the rotary drive;

B) an electrical signal delivered to said piezoelectric element to cause said piezoelectric element to apply time-alternating force to the workpiece holder to displace the workpiece along the axis of rotation;

C) an electrical conductivity of the slurry-containing liquid defined by ions therein; and D) at least one of a spatial orientation parameter and a spatial position parameter of the first component of the carrier chuck with respect to the support component.

19. The apparatus according to claim 18, wherein the at least one of the spatial orientation parameter and the spatial position parameter include a speed of rotation of the table and/or a speed of rotation of the workpiece holder.

20. The apparatus according to claim 1, further comprising a rotary drive operably connected to the carrier chuck and to the microcontroller, the carrier chuck being rotatably connected to the rotary drive, the microcontroller being configured to control the rotary drive to apply a pressure to the workpiece holder to force the workpiece holder towards the support component.

21. A method for chemical-mechanical polishing of a workpiece, wherein the method comprises:

(i) use of the apparatus of claim 1;

(ii) positioning the support component on the table of the apparatus;

(iii) securing a workpiece in the workpiece holder of the apparatus with the use of magnets;

(iv) polishing the workpiece by:

a. rotating the support component and the polishing pad adhered to an up-facing surface thereon on the table about the axis of rotation with respect to the workpiece while the workpiece is in contact with the polishing pad, and b. delivering a slurry-containing liquid to the polishing pad;

(v) during said polishing the workpiece: electrically-biasing a working electrode in the chuck head with respect to an additional electrode, wherein the additional electrode either extends into the reservoir from the electrode holder through an opening in the reservoir or is firmly embedded in the reservoir, based on an electrical parameter acquired by the measurement system from a combination of the first electrode and the additional electrode in contact with a slurry-containing liquid and the working electrode electrically-connected to the back side of the workpiece secured in the workpiece holder by the measurement system of the apparatus to change an ionic conductivity of the slurry-containing liquid;

(vi) adjusting at least one of a speed of rotation of the table and a speed of rotation of the workpiece holder.

22. The method according to claim 21, wherein the adjusting at least one of a speed of rotation of the table and a speed of rotation of the workpiece holder is performed while the said polishing the workpiece is continued.

23. The method according to claim 21, further comprising: during said rotating, applying a pulsed pressure to the workpiece in a direction of the polishing pad by delivering electrical pulses through the slip-ring from a signal generator of the electrical circuitry to a piezoelectric element contained in the carrier chuck.

24. The method according to claim 23, wherein the apparatus further comprises a working electrode in the chuck head, said working electrode electrically connected to the microcontroller and the potentiometer through the slip-ring and to a back surface of the workpiece when the workpiece is secured in the chuck head, wherein said chuck head includes an acoustic sensor disposed therein and electrically connected with the microcontroller through the slip-ring, wherein the microcontroller is configured to receive a signal from an acoustic sensor representing mechanical vibrations of a component of the apparatus during an operation of the apparatus and to determine an eigenfrequency of said mechanical vibrations, wherein the microcontroller is configured to receive a reading provided at least by the additional electrode and to bias the working electrode with respect to the additional electrode by applying an electric potential to the working electrode such as to adjust a flow of current passing through the workpiece, the method further comprising: during said rotating the support component, measuring said eigenfrequency with the acoustic sensor when no voltage is applied to the piezoelectric element, and adjusting frequency of the electrical pulses, delivered through the slip-ring to the piezoelectric element, to the eigenfrequency within +/−20% or +/−10% or +/−5% of a value of the eigenfrequency based on said measuring.

* * * * *